US008125472B2

(12) United States Patent
Cok et al.

(10) Patent No.: US 8,125,472 B2
(45) Date of Patent: Feb. 28, 2012

(54) DISPLAY DEVICE WITH PARALLEL DATA DISTRIBUTION

(75) Inventors: Ronald S. Cok, Rochester, NY (US); Christopher J. White, Avon, NY (US)

(73) Assignee: Global OLED Technology LLC, Herndon, VA (US)

( * ) Notice: Subject to any disclaimer, the term of this patent is extended or adjusted under 35 U.S.C. 154(b) by 486 days.

(21) Appl. No.: 12/480,814

(22) Filed: Jun. 9, 2009

(65) Prior Publication Data

US 2010/0309100 A1 Dec. 9, 2010

(51) Int. Cl.
*G09G 5/00* (2006.01)

(52) U.S. Cl. ..... 345/204; 345/98; 345/100; 345/217; 345/90; 315/169.1; 315/169.2; 315/307; 315/312

(58) Field of Classification Search .... 315/169.1–169.3, 315/291, 307, 312; 345/80, 82, 84, 87, 92, 345/98, 100, 102, 204, 205, 217; 385/901
See application file for complete search history.

(56) References Cited

U.S. PATENT DOCUMENTS

| | | | | |
|---|---|---|---|---|
| 5,680,063 | A | 10/1997 | Ludwig | |
| 5,739,802 | A * | 4/1998 | Mosier | 345/89 |
| 6,259,838 | B1 | 7/2001 | Singh et al. | |
| 6,384,529 | B2 | 5/2002 | Tang | |
| 6,580,657 | B2 * | 6/2003 | Sanford et al. | 365/230.05 |
| 7,078,670 | B2 | 7/2006 | Atlas et al. | |
| 7,973,472 | B2 * | 7/2011 | Cok | 313/506 |
| 2004/0012565 | A1 * | 1/2004 | Cok | 345/158 |
| 2006/0055864 | A1 | 3/2006 | Matsumura et al. | |
| 2008/0252588 | A1 * | 10/2008 | Huang | 345/100 |
| 2011/0050658 | A1 * | 3/2011 | White et al. | 345/205 |

FOREIGN PATENT DOCUMENTS

| | | |
|---|---|---|
| DE | 199 50 839 A1 | 5/2001 |
| EP | 1 437 703 A1 | 7/2004 |
| EP | 1 531 449 A1 | 5/2005 |

* cited by examiner

*Primary Examiner* — Haiss Philogene
(74) *Attorney, Agent, or Firm* — Morgan, Lewis & Bockius LLP

(57) ABSTRACT

A display device responsive to a controller, including a substrate having a display area; a two-dimensional array of pixels formed on the substrate in the display area, each pixel comprising an optical element and a driving circuit for controlling the optical element in response to selected pixel information; a two-dimensional array of selection circuits located in the display area, each associated with one or more pixels, for selecting pixel information provided by the controller, wherein each selection circuit receives the provided pixel information, selects pixel information corresponding to its associated pixel(s) in response to the provided pixel information, and provides the selected pixel information to the corresponding driving circuit(s); and a parallel signal conductor electrically connecting the selection circuits in common for transmitting pixel information provided by the controller to each of the selection circuits.

20 Claims, 12 Drawing Sheets

DISPLAY DEVICE WITH PARALLEL DATA DISTRIBUTION

CROSS-REFERENCE TO RELATED APPLICATIONS

Reference is made to commonly-assigned, co-pending U.S. patent application Ser. No. 12/371,666 filed Feb. 16, 2009, entitled "Chiplet Display Device with Serial Control" to Cok, and to commonly-assigned, co-pending U.S. patent application Ser. No. 12/372,906 filed Feb. 18, 2009, entitled "Display Device with Chiplet Drivers" to Cok et al., the disclosures of which are incorporated herein.

FIELD OF THE INVENTION

The present invention relates to display devices having a substrate with distributed, independent chiplets employing parallel control for a pixel array.

BACKGROUND OF THE INVENTION

Flat-panel display devices are widely used in conjunction with computing devices, in portable devices, and for entertainment devices such as televisions. Such displays typically employ a plurality of pixels distributed over a substrate to display images. Each pixel incorporates several, differently colored light-emitting elements commonly referred to as sub-pixels, typically emitting red, green, and blue light, to represent each image element. As used herein, pixels and sub-pixels are not distinguished and refer to a single light-emitting element. A variety of flat-panel display technologies are known, for example plasma displays, liquid crystal displays, and light-emitting diode (LED) displays.

Light emitting diodes (LEDs) incorporating thin films of light-emitting materials forming light-emitting elements have many advantages in a flat-panel display device and are useful in optical systems. U.S. Pat. No. 6,384,529 issued May 7, 2002 to Tang et al. shows an organic LED (OLED) color display that includes an array of organic LED light-emitting elements. Alternatively, inorganic materials can be employed and can include phosphorescent crystals or quantum dots in a polycrystalline semiconductor matrix. Other thin films of organic or inorganic materials can also be employed to control charge injection, transport, or blocking to the light-emitting-thin-film materials, and are known in the art. The materials are placed upon a substrate between electrodes, with an encapsulating cover layer or plate. Light is emitted from a pixel when current passes through the light-emitting material. The frequency of the emitted light is dependent on the nature of the material used. In such a display, light can be emitted through the substrate (a bottom emitter) or through the encapsulating cover (a top emitter), or both.

Two different methods for controlling the pixels in a flat-panel display device are generally known: active-matrix control and passive-matrix control. In a passive-matrix device, the substrate does not include any active electronic elements (e.g. transistors). An array of row electrodes and an orthogonal array of column electrodes in a separate layer are formed over the substrate; the intersections between the row and column electrodes form the electrodes of a light-emitting diode. External drivers then sequentially supply current to each row (or column) while the orthogonal column (or row) supplies a suitable voltage to illuminate each light-emitting diode in the row (or column).

In an active-matrix device, an active pixel circuit controls each pixel. Typically, each pixel circuit includes at least one transistor. For example, referring to FIG. 8, in a simple active-matrix organic light-emitting (OLED) display known in the prior art, each pixel 89 includes an optical element 15, e.g. an OLED emitter, controlled by a pixel circuit 80 that includes a selection circuit 801 and a driving circuit 802. The selection circuit 801 includes select transistor 81 for selecting pixel information, and a capacitor 84 for storing a charge specifying the desired luminance of the pixel. The driving circuit 802 includes a drive transistor 82 for providing current to optical element 15. Control of the optical element 15 is typically provided through a data signal line 85 and a select signal line 86.

Referring to FIG. 9, according to the prior art, an active-matrix display 90 includes a matrix 91 of pixels 89 arranged in rows and columns, each having a selection circuit 801 as described above. Each row has a respective select signal line (85*a*, 85*b*, 85*c*), and each column has a respective data signal line (86*a*, 86*b*, 86*c*). A gate driver 95 controls the select signal lines and source driver 96 controls data signal lines. Therefore, any failure in any select signal line 85 or data signal line 86 (e.g. as shown in FIG. 8), or a gate driver 95 or a source driver 96 providing signals on that line, causes malfunction of the pixels attached to that line. Data signal lines are commonly referred to as column lines, and select signal lines are commonly referred to as row lines, but those terms do not require any particular orientation of the panel. Furthermore, each selection circuit 801 is connected to a unique pair (data signal line 85, select signal line 86), and is addressed by that pair.

One common, prior-art method of forming active-matrix pixel circuits deposits thin films of semiconductor materials, such as silicon, onto a glass flat-panel substrate and then forms the semiconductor materials into transistors and capacitors through photolithographic processes. The thin-film silicon can be either amorphous or polycrystalline. Thin-film transistors (TFTs) made from amorphous or polycrystalline silicon are relatively large and have lower performance compared to conventional transistors made in crystalline silicon wafers. Moreover, such thin-film devices typically exhibit local or large-area non-uniformity across the glass substrate that results in non-uniformity in the electrical performance and visual appearance of displays employing such materials.

Employing an alternative control technique, Matsumura et al describe crystalline silicon substrates used for driving LCD displays in U.S. Patent Application Publication No. 2006/0055864. The application describes a method for selectively transferring and affixing pixel-control devices made from first semiconductor substrates onto a second planar display substrate. Wiring interconnections within the pixel-control device and connections from busses and control electrodes to the pixel-control device are shown. A matrix-addressing pixel control technique is taught.

Both the active-matrix and the passive-matrix control schemes rely on matrix addressing, the use of two control lines (e.g. 85, 86 in FIG. 8) for each pixel to select that pixel. This technique is used because other schemes such as direct addressing (for example as used in memory devices) require the use of address decoding circuitry that is very difficult to form on a conventional thin-film active-matrix back plane, and is impossible to form on a passive-matrix back-plane as such a back-plane lacks transistors. Another data communication scheme used e.g. in CCD image sensors as taught in U.S. Pat. No. 7,078,670, employs a parallel data shift from one row of sensors to another row, and eventually to a serial shift register that is used to output the data from each sensor element. This arrangement requires interconnections between every row of sensors and an additional, high-speed serial shift register. Moreover, the logic required to support such data shifting would require so much space in a conventional thin-film transistor active-matrix back-plane that the resolution of the device would be severely limited, and would be impossible in a passive-matrix back-plane, which lacks transistors.

U.S. Pat. No. 6,259,838 to Singh et al. teaches a display device employing a plurality of light-emitting elements disposed along the length of a light-emitting fiber, such as an optical fiber. This scheme provides a one-dimensional flow of information controlling OLED display elements arranged along the fiber. However, in high-resolution displays, this scheme requires precise positioning of a large number of fibers, e.g. one per row. Positioning errors can cause visible non-uniformity and reduce yields. Furthermore, any breaks in the fiber can deactivate all pixels after the break, or all pixels attached to the fiber.

Both matrix-addressed and serially shifted control schemes for display devices are vulnerable to interconnect failures. Typically, a single row or column connection failure results in an entire row or column fault. Such failures can occur in manufacturing or from use.

It is known to employ bi-directional level shifters to transmit signals having different voltage levels on two portions of a single bus. For example, U.S. Pat. No. 5,680,063 to Ludwig et al. describes such a circuit.

There is a need, therefore, for an improved apparatus for display devices that improves the tolerance of the display to wiring interconnection faults.

SUMMARY OF THE INVENTION

In accordance with the present invention, there is provided a display device responsive to a controller, comprising:

(a) a substrate having a display area;

(b) a two-dimensional array of pixels formed on the substrate in the display area, each pixel comprising an optical element and a driving circuit for controlling the optical element in response to selected pixel information;

(c) a two-dimensional array of selection circuits located in the display area, each associated with one or more pixels, for selecting pixel information provided by the controller, wherein each selection circuit receives the provided pixel information, selects pixel information corresponding to its associated pixel(s) in response to the provided pixel information, and provides the selected pixel information to the corresponding driving circuit(s); and (d) a parallel signal conductor electrically connecting the selection circuits in common for transmitting pixel information provided by the controller to each of the selection circuits.

An advantage of the present invention is that the use of the selection circuit responsive to the pixel information is a more efficient design that reduces wiring complexity of the display device. Furthermore, a display device of the present invention is more tolerant of wiring and interconnection faults than the prior art. The display device will continue to operate normally in the presence of single-point wiring faults. A further advantage is that the cost of driver circuitry and display manufacturing can be reduced compared to the prior art, as drivers can be shared, reducing bond-out requirements.

Figure 1A:
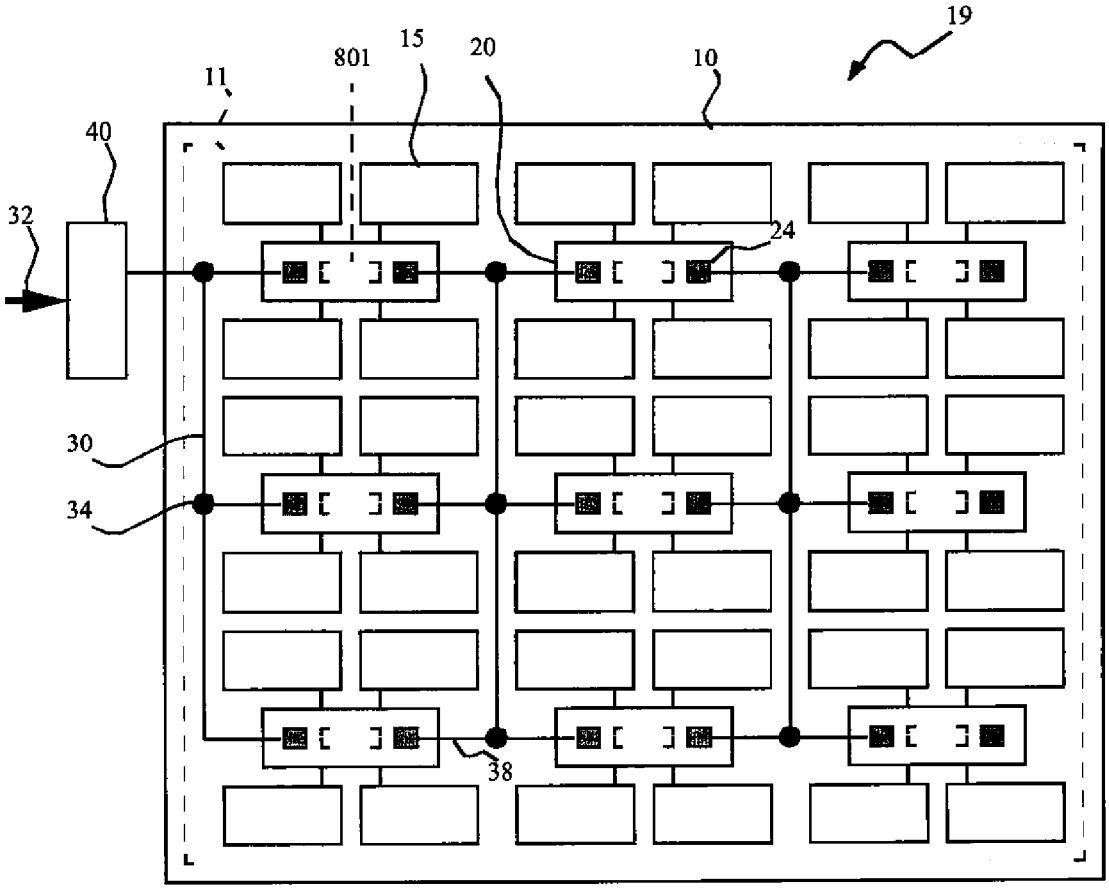
FIG. 1A is a schematic illustrating pixels and chiplets distributed over a display area in an embodiment of the present invention.

Because the various layers and elements in the drawings have greatly different sizes, the drawings are not to scale.

DETAILED DESCRIPTION OF THE INVENTION

Figure 10:
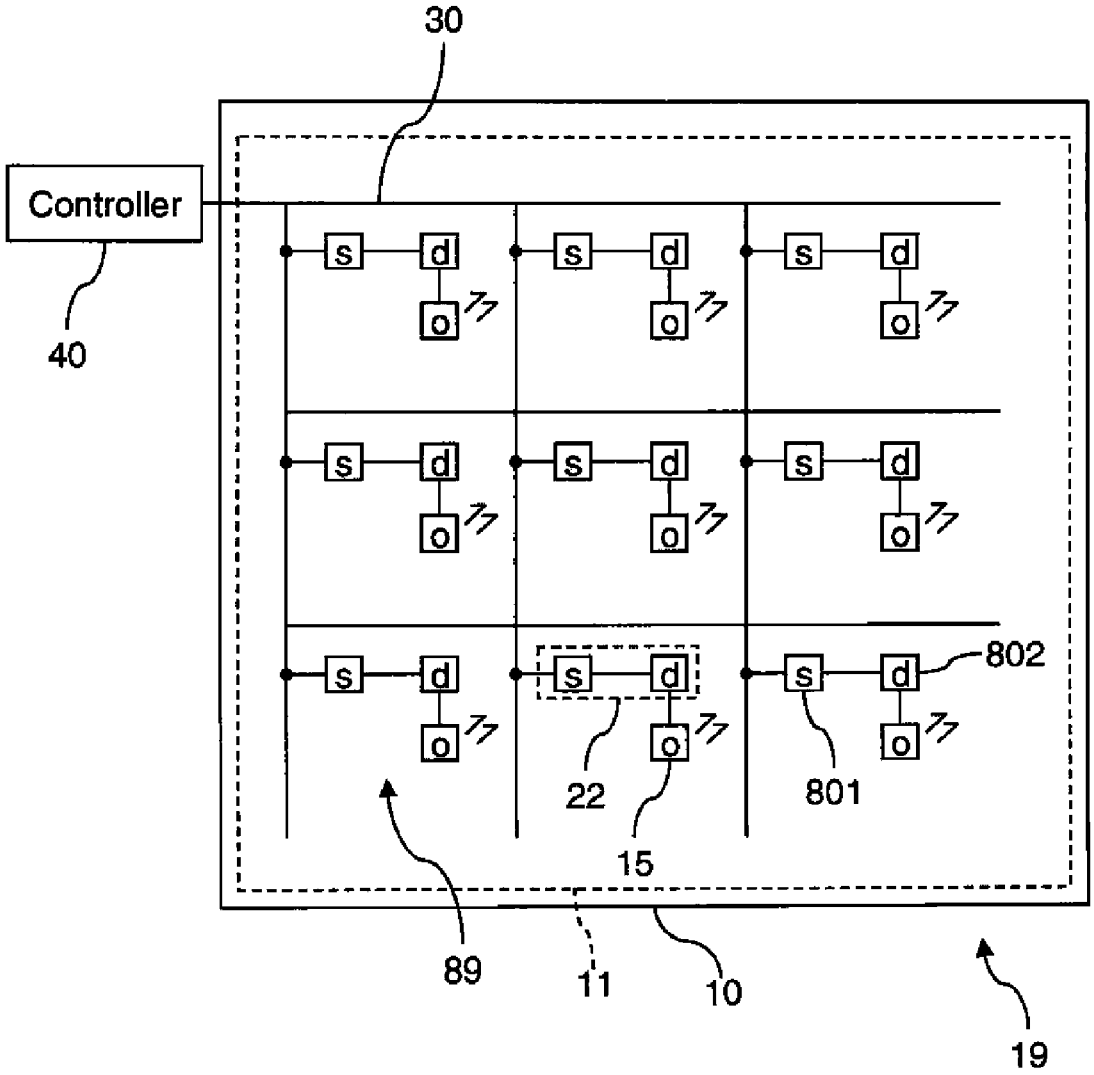
FIG. 10 is a schematic of a display according to an embodiment of the present invention.

Referring to FIG. 10, a display device 19 responsive to a controller 40 includes a plurality of pixels 89, each having an optical element 15 and a driving circuit 802 for controlling the optical element 15 in response to selected pixel information. The pixels are arranged in a two-dimensional array, which can be a regular grid characterized by a repeating cell of consistent dimensions, or an irregular arrangement not having such a cell, but having more than one pixel arranged in each of two directions that are separated by an angle of more than 30 degrees.

Display device 19 further includes a plurality of selection circuits 801, each associated with one or more pixels 89, for selecting pixel information provided by the controller 40. The selection circuits 801 are also arranged in a two-dimensional array as described above. Each selection circuit 801 receives the provided pixel information from the controller 40, selects the pixel information corresponding to its associated pixel(s) 89 in response to the provided pixel information, and provides the selected pixel information to the corresponding driving circuit(s) 802. A parallel signal conductor 30 electrically connects the plurality of selection circuits 801 in common for transmitting pixel information provided by the controller 40 to each of the selection circuits 801. The parallel signal conductor 30 is controlled by the controller 40. The parallel signal conductor 30 is not a daisy-chained conductor connecting all the selection circuits; it connects at least two of the selection circuits in parallel according to the electronics art. The plurality of pixels 89 and the plurality of selection circuits 801 are located in a display area 11 formed on a substrate 10. The pixels 89 are also formed on the substrate 10. In one embodiment of the present invention, a separate selection circuit 801 drives each driving circuit 802, as shown in FIG. 10, so each selection circuit 801 is associated with only one driving circuit 802, and thus with only one pixel 89.

Figure 11:
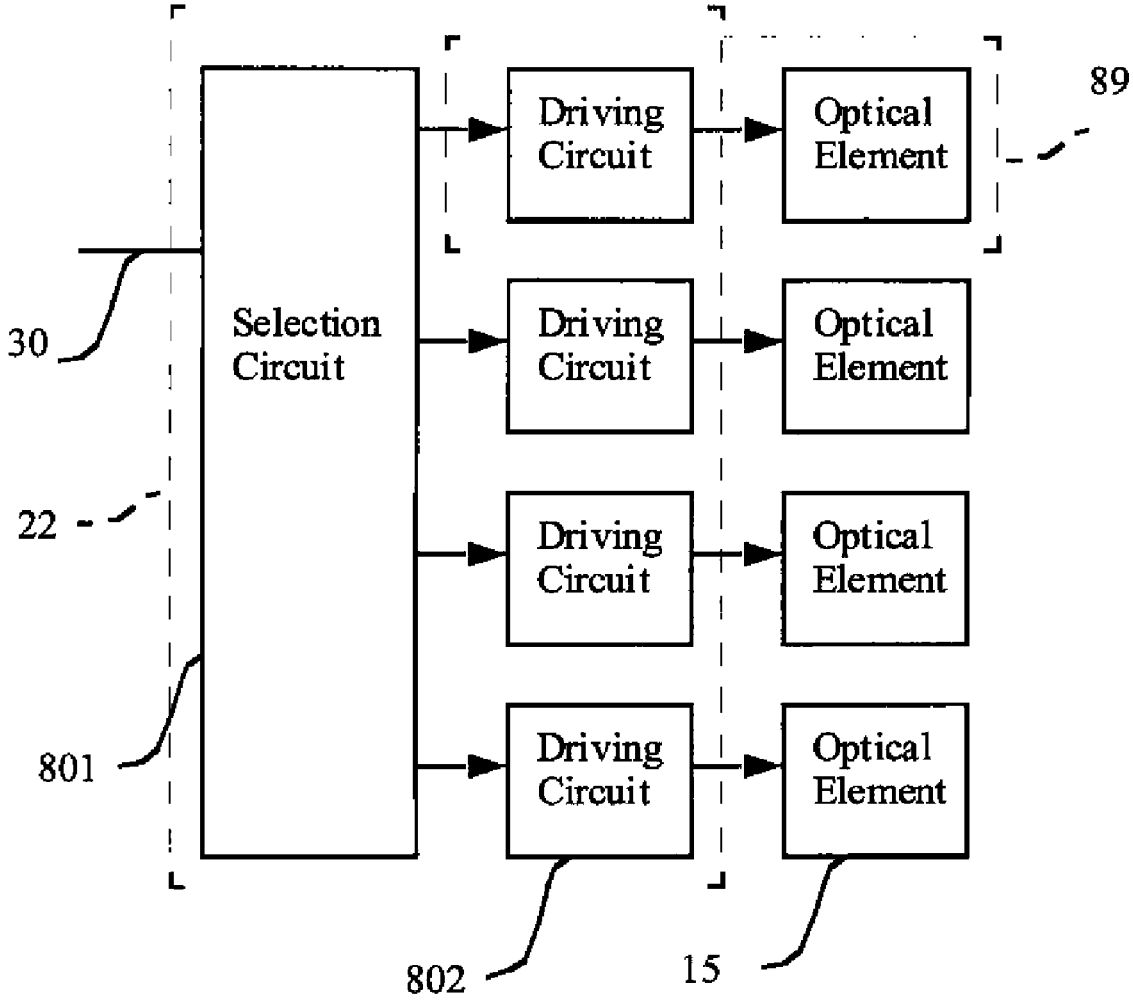
FIG. 11 is a schematic of a display portion according to an alternative embodiment of the present invention.

Referring to FIG. 11, in an alternative embodiment of the present invention, a selection circuit 801 is associated with multiple pixels 89 and provides respective selected pixel information from parallel signal conductor 30 to the respective driving circuits 802 in the pixels 89. A pixel circuit 22 can include both one or more driving circuits 802 and the selection circuit 801 and can drive one pixel 89 or a plurality of pixels 89.

Figure 1B:
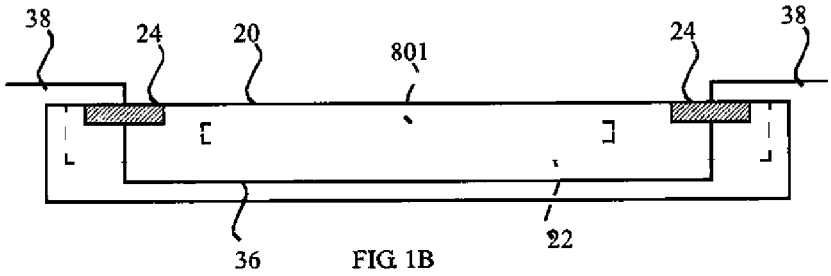
FIG. 1B is a cross-section of a chiplet useful in the embodiment of FIG. 1A.

Referring to FIGS. 1A, 1B, and 11, in an embodiment of the present invention, the pixel circuit 22 is formed within a chiplet 20 for controlling the optical elements 15 in display area 11 on substrate 10. A pixel circuit 22 having a single selection circuit 802 and multiple driving circuits 802, or a plurality of such pixel circuits 22, can be integrated on a single chiplet 20 as will be discussed below. In general, each chiplet can contain at least one driving circuit and at least one selection circuit, arranged in various ways. At least one parallel signal conductor 30 electrically connects the plurality of selection circuits 801 in common for transmitting pixel information to each of the selection circuits 801. The pixel information is carried in a pixel-information signal, which can be provided directly on the parallel signal conductor or modulated according to various techniques known in the art such as AM, FM, PCM or PWM, can be compressed using techniques known in the art such as Huffman coding or DCT, or encoded using techniques known in the art such as trellis modulation. The parallel signal conductor 30 is a parallel buss and can include one or more wires electrically connected in common to the plurality of selection circuits 801. As shown in FIG. 1A, the parallel signal conductor 30 can include wires distributed over the substrate display area 11 in a two-dimensional grid structure having orthogonal wires connected with interconnections 34. Similarly, the pixels can be arranged in rows and columns to form a two-dimensional array.

Figure 1C:
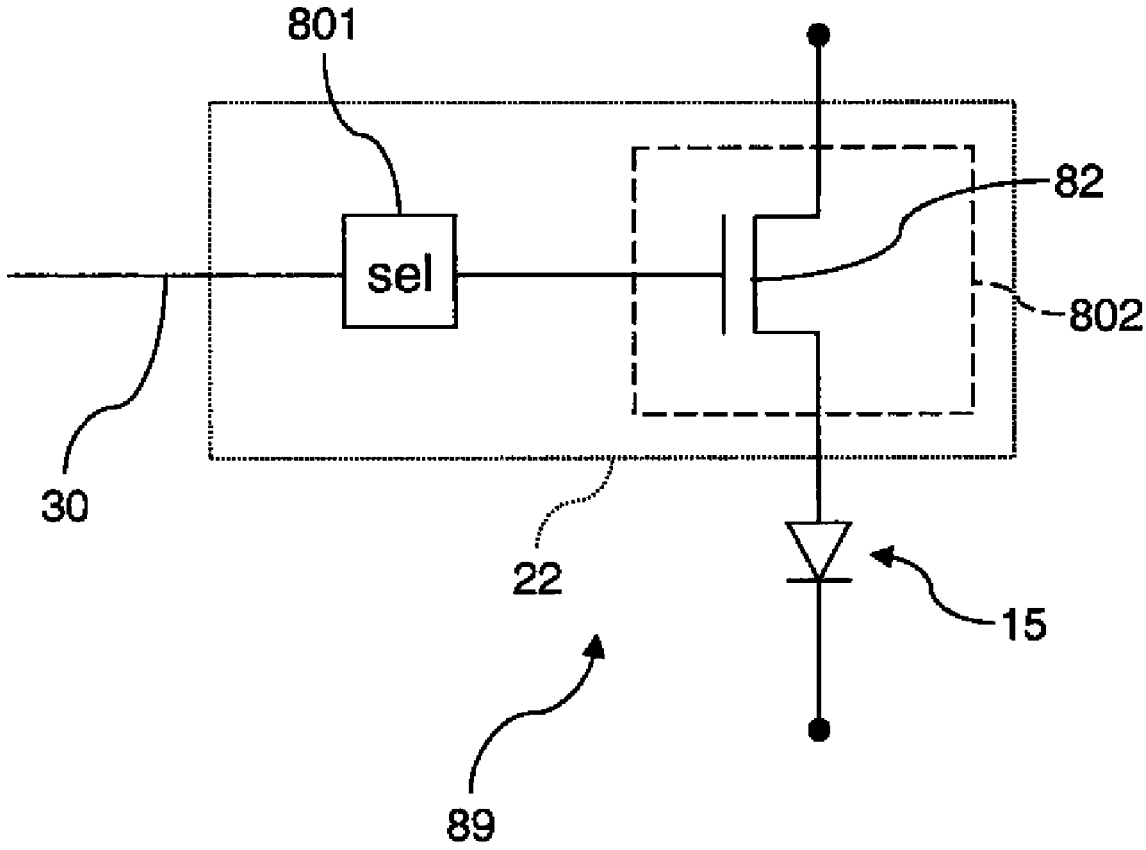
FIG. 1C is a schematic of a pixel in the embodiment of FIG. 1A.

Referring to FIG. 1C, in one embodiment, the optical element 15 in pixel 89 can be a light-emitting element, such as an electro-luminescent (EL) emitter, and can preferably be an organic light-emitting diode (OLED). The pixel circuit 22 can provide a current to the optical element 15 to cause it to emit light using driving circuit 802 having drive transistor 82. The optical element 15 can include a color filter. Pixel circuit 22 can include selection circuit 801 for selecting pixel information corresponding to the pixel, as will be discussed below, in response to a signal on parallel signal conductor 30.

The optical element 15 can also be a light-controlling element, such as a liquid crystal. Light-controlling elements can include crossed polarizers for restricting the passage of light from a backlight in accordance with a voltage provided to the light-controlling element by the driving circuit.

Referring back to FIGS. 1A and 1B, the pixel circuits 22 can be implemented in thin-film circuitry or in chiplets 20. The pixel circuits 22 can include data storage elements storing information specifying the desired luminance of the pixels. Chiplets are integrated circuits formed on a substrate separate from, and smaller than, the substrate 10 and located over the substrate 10 in the display area 11 to receive pixel information and drive the pixels. Multiple pixel circuits 22 can be implemented within a single chiplet 20.

In one embodiment of the present invention employing chiplets 20, each chiplet 20 includes multiple, different connection pads 24. Connection pads 24 are electrically connected to each other with buss portions 36 located within the chiplets 20 to maintain the electrical continuity of the parallel signal conductor 30 over the display area. Buss portions 38 of the parallel signal conductor 30 formed on the substrate 10 are electrically interconnected with the chiplet buss portions 36 through the connection pads 24 in the chiplets 20. Other connection pads (not shown) in the chiplet or in a thin-film circuit can drive the optical elements 15 or connect to other busses (not shown).

The controller 40 drives the parallel signal conductor 30 with pixel information produced from an image signal 32. The controller 40 responds to an image signal 32 and includes a driver for transmitting pixel information produced from the image signal 32 through the parallel signal conductor 30 to the pixel circuits 22. The pixel circuits 22 then drive the optical elements 15 using the pixel information, for example driving the optical elements 15 to emit light at a luminance specified in the pixel information.

Referring also to FIGS. 1C and 10, the pixel information communicated over the parallel signal conductor 30 travels to all of the pixel circuits 22, and specifically to all the selection circuits 801. However, only a different subset of the information is needed by each of the pixel circuits 22 associated with one or more of the pixels. Each pixel circuit 22 therefore uses the corresponding selection circuit 801 to select only the pixel information relevant to the associated pixels that the pixel circuit drives. Unlike the prior art, selection circuit 801 responds to all of the pixel information on parallel signal conductor 30 and selects the portion of pixel information relevant to its corresponding pixel(s). Selection circuit 801 does not require matrix control signals, e.g. the select signal line 85 shown in FIG. 8. A variety of methods can be employed to distribute the information to the pixel circuits 22, and to permit selection circuits 801 to select the relevant pixel information.

Referring to FIG. 10, and also to FIG. 1A, in one embodiment of the present invention, the pixel information is formatted in discrete data values. The data values are arranged in a temporally sequential fashion and transmitted to the selection circuits 801. Each pixel 89 has a unique index value. For example, each selection circuit 801 can include a set of switches or pad connections specifying binary value(s) that are the index or indices for any associated pixel(s). Each selection circuit 801 counts the data values transmitted on parallel signal conductor 30 and selects the data value(s) corresponding to the index or indices of its associated pixel (s). For example, a pixel with an address of 3 receives the 3rd successive data value transmitted on parallel signal conductor 30. Each selection circuit 801 includes a counter that counts the data values of pixel information until the pixel information corresponding to a particular pixel 89 is transmitted, at which point that associated pixel information is stored by the corresponding selection circuit 801 in a data storage element associated with the pixel, for example in digital storage elements such as flip flops or memories, or in analog storage elements such as capacitors. The index values for pixels 89 can be assigned in a rasterized order of pixels 89 on the display, such as left-to-right, top-to-bottom.

The data values transmitted on the parallel signal conductor 30 can also be packets of pixel information for one or more pixels 89. When multiple driving circuits 802 are implemented within a single chiplet 20, each chiplet 20 can preferably have a unique index value, and each packet of pixel information can include pixel information for each of the associated pixels 89 controlled by the corresponding chiplet 20.

A selected reserved value can be transmitted on the parallel signal conductor to indicate the counter in each selection circuit 801 should be reset, e.g. at the beginning of a frame. Such techniques are well known in the communications art. For example, in a DC-balanced code, a long run of 0's or 1's can signal a reset.

In an alternative embodiment of the present invention, the pixel information is formatted in packets, each packet of pixel information includes a respective address value, and each pixel 89 has a corresponding address value. Address values will be discussed further below. Each selection circuit 801 includes a matching circuit (e.g. a comparator) that compares the address value of each packet transmitted on parallel signal conductor 30 with the respective address value(s) of its corresponding pixel(s). When the matching circuit indicates a packet address value matches an associated pixel's address value, the pixel information in the packet having the matching address is stored. Each selection circuit 801 can include circuitry, such as flip-flops or PROM, defining the address(es) for its associated pixel(s).

Packets of pixel information can be combined or divided as necessary to transport them robustly over the parallel signal conductor 30, as known in the internetworking art.

The present invention provides improved robustness to signals transmitted over the display area 11. If any one pixel circuits 22 fail, other pixel circuits 22 and pixels are not affected. If a small number of breaks occur in the parallel signal conductor 30, pixel information can still be transmitted to each pixel circuit by 22 other electrical paths. Hence, even in the presence of manufacturing faults or failure due to mechanical stress of the display, the display can continue to operate.

Figure 2A:
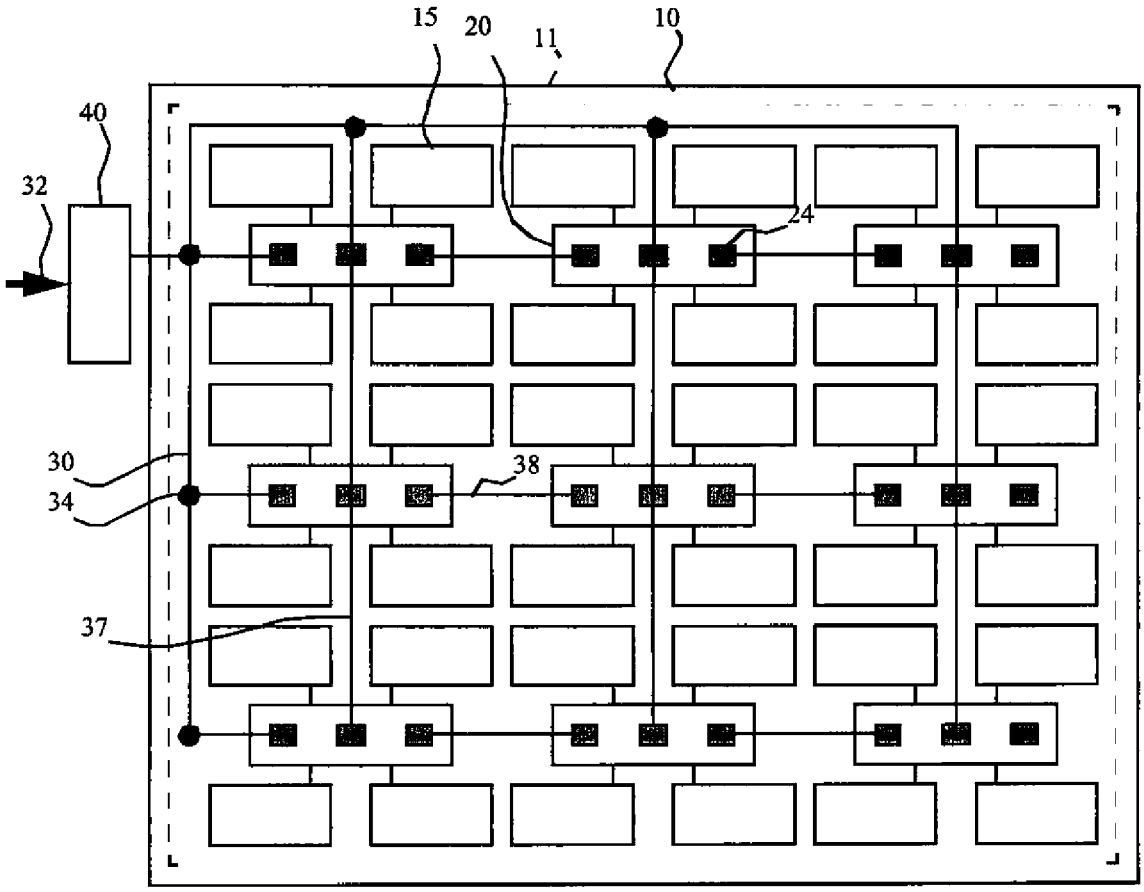
FIG. 2A is a schematic illustrating pixels and chiplets distributed over a display area in an alternative embodiment of the present invention.
Figure 2B:
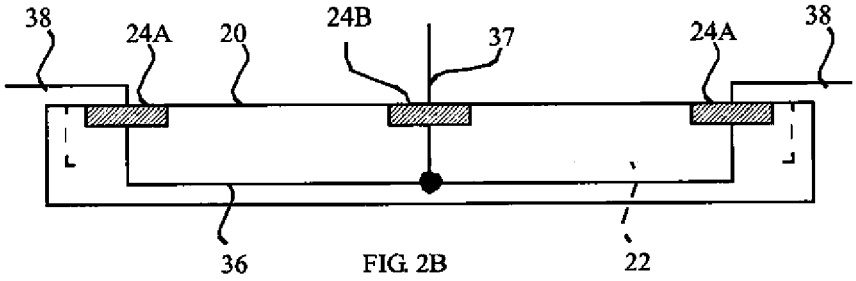
FIG. 2B is a cross-section of a chiplet useful in the embodiment of FIG. 2A.

FIGS. 1A and 1B illustrate an embodiment of the present invention in which buss portions 36 of the parallel signal conductor 30 pass through chiplets 20. In other embodiments of the present invention, the parallel signal conductor 30 is directly connected to multiple chiplets 20 without necessarily passing through any chiplets 20. Referring to FIG. 2A, in an embodiment of the present invention, multiple chiplets 20 are directly connected through a connection pad 24 to a buss portion 37 of the parallel signal conductor 30. Buss portions 38 of the parallel signal conductor 30 also pass through the chiplets as in FIGS. 1A and 1B. FIG. 2B illustrates an electrical connection in the chiplet 20 between the parallel signal conductor 30 buss portions 37 through connection pad 24B and 38 through connection pad 24A using buss portion 36.

Figure 3:
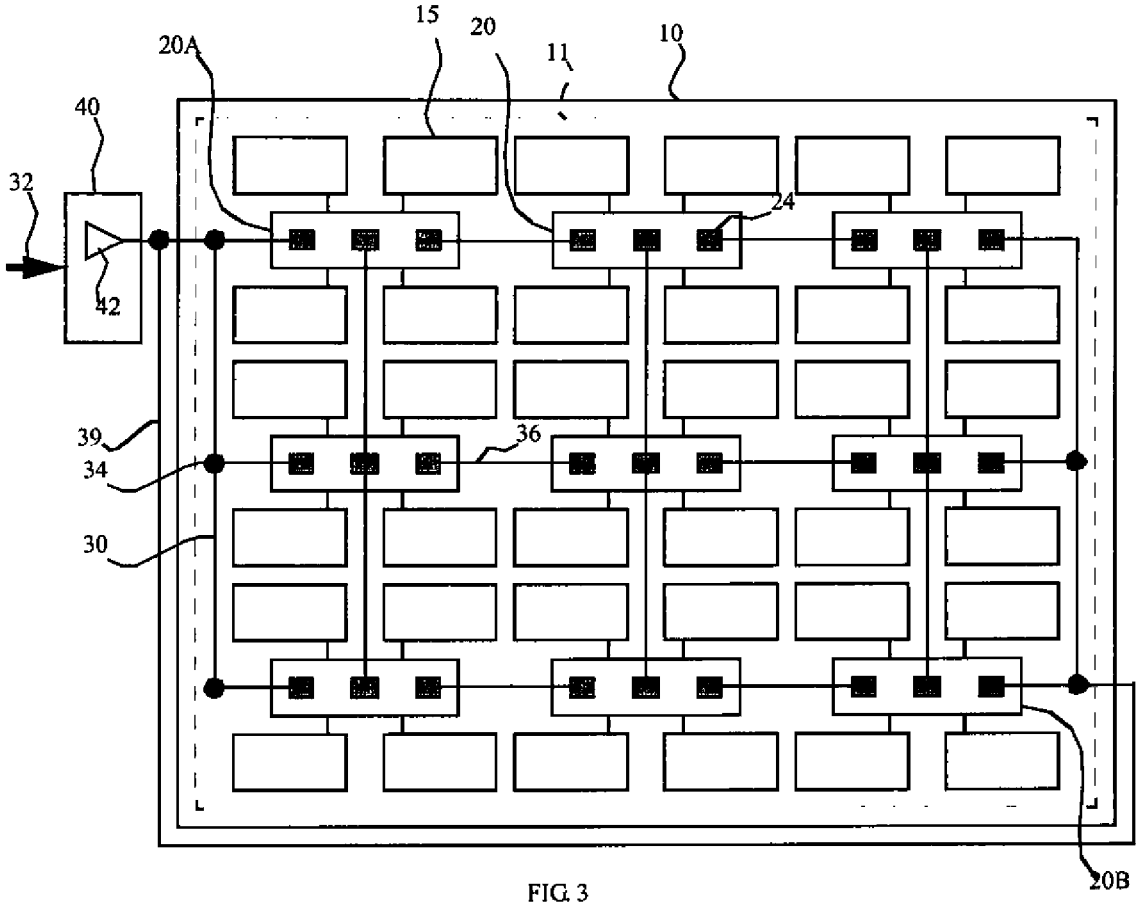
FIG. 3 is a schematic illustrating pixels and chiplets distributed over a display area in another embodiment of the present invention.

The embodiments of the present invention illustrated in FIGS. 1A, 1B, 2A, and 2B employ a single connection at a single location to the parallel signal conductor 30 from a controller 40. In a large display, for example a display that has a diagonal greater than 40 inches, the distance the pixel information has to travel over the parallel signal conductor 30 can be quite large. Moreover, the conductivity of the parallel signal conductor 30 over the substrate 10 in the display area 11 can be limited due to the width, thickness, material, or deposition technique used to form the wire(s) making up the parallel signal conductor 30. Hence, in a further embodiment of the present invention, the controller 40 can drive the parallel signal conductor 30 at multiple different locations on the substrate. Referring to FIG. 3, a buss portion 39 can electrically connect a signal driver 42 to the parallel signal conductor 30 in the display area 11 at multiple different locations, for example to chiplet 20A and chiplet 20B. The buss portion 39 can be a separate wire external to the substrate 10, as shown or formed on the substrate 10 external to the display area 11. Although FIG. 3 illustrates only two connections, the present invention is not limited to two and any number of connection locations at different locations can be employed. Alternatively, referring to FIG. 4B, two or more separate, synchronized signal drivers 42 attached to parallel signal conductor 30 at different locations can be used instead of a single driver connected to two different points.

A parallel buss that runs a long distance over a substrate, or that contains branches or stubs, is subject to signal reflections. The parallel signal conductor 30 of the present invention can experience such reflections that can degrade the signal quality. As is known in the prior art, by providing signal termination elements, for example selected resistors, such reflections can be reduced. However, reflections cannot be entirely eliminated when signals are introduced into a parallel conductor grid, which parallel signal conductor 30 can be. Signals are also subject to spreading due to propagation delays as they travel through the grid. Pixel circuits 22 electrically connected to the parallel signal conductor 30 can thus receive a noisy pixel-information signal, i.e. a signal in which the pixel information is wholly or partially corrupted or obscured by electrical noise. This problem can also result from multiple, different electrical connection points. Such multiple connections can reduce overall propagation time and improve signal strength over the display area, but can cause signals to arrive at different pixel circuits 22 at different times. Therefore, according to an embodiment of the present invention, selection circuit 801 can include a signal filter 44 or an isolation driver 43 arranged to filter pixel information from the parallel signal conductor 30. A variety of signal filters 44 can be employed to accommodate a noisy pixel-information signal; for example an RC low-pass filter circuit can reduce high-frequency noise in the signal. This is particularly useful if the selection circuit 802 employs an edge-sensitive storage circuit 46, such as a flip-flop, to store pixel information.

Figure 4A:
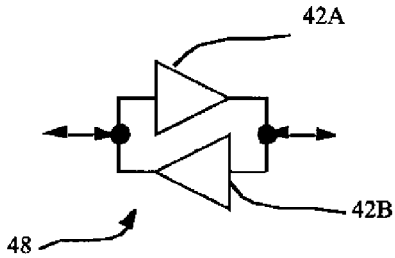
FIG. 4A is a simplified schematic illustrating a bi-directional driver useful in an embodiment of the present invention.

In a further embodiment of the present invention, the pixel-information signal is reconstructed at different locations along the parallel signal conductor 30 to improve the signal strength by including signal driver circuits distributed in the display area 11 that receive and transmit pixel information on the parallel signal conductor 30. These driver circuits are preferably bi-directional signal drivers 48. As simply illustrated in FIG. 4A, such bi-directional signal drivers 48 includes signal drivers 42A and 42B having complementary directions, so that each bi-directional signal driver drives the pixel-information signal in each direction. However, such drivers require careful design to prevent oscillation and to guarantee the output circuit component for one driver is compatible with the input circuit component for the other driver. Examples of such bi-directional driver circuits are known in the art.

Figure 4B:
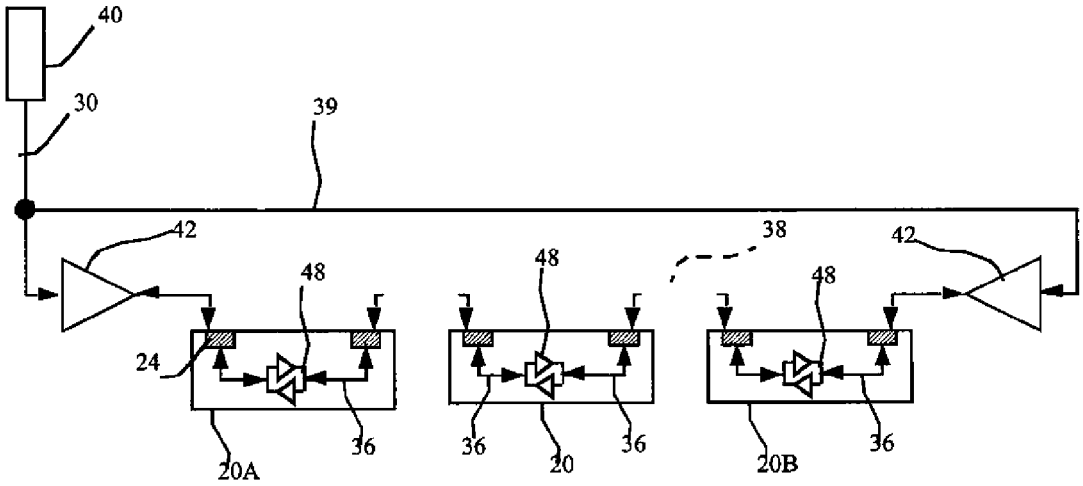
FIG. 4B is a schematic of chiplets having bi-directional drivers useful in an alternative embodiment of the present invention illustrated in FIG. 3.

Referring to FIG. 4B, the bi-directional signal drivers 48 can be conveniently located in the chiplets 20, 20A, 20B to reconstitute the pixel-information signal on buss portions 36A and 36B. Alternatively, the bi-directional driver circuits can be formed with thin-film circuitry at various locations over the substrate 10 in the display area 11. The bi-directional signal drivers 48 can be employed with the signal filter circuitry 44.

In various embodiments of the present invention, the parallel signal conductor 30 is a wired-AND configuration as known in the electronics art. This is an active-low bus with passive pull-ups, which can be driven by open-drain signal drivers.

Figure 7:
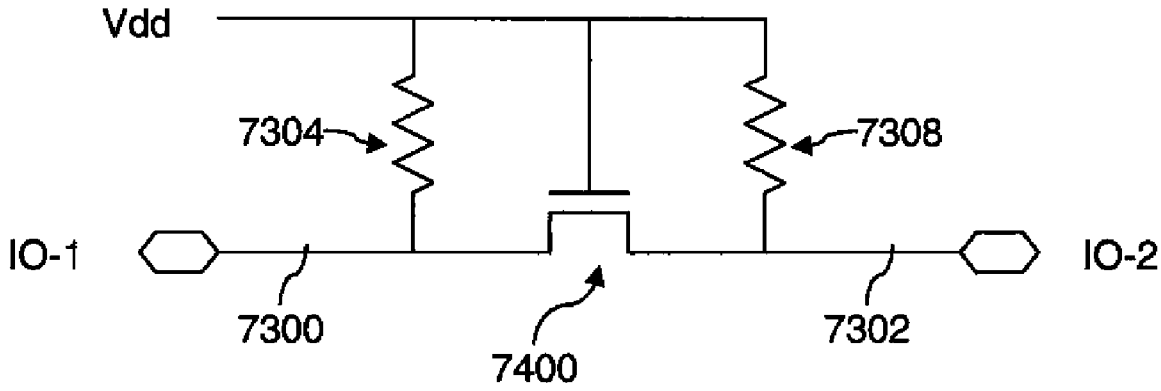
FIG. 7 is a schematic of a bi-directional signal driver useful in the present invention.

Referring to FIG. 7, in one embodiment with a wired-AND signal conductor, a bi-directional signal driver 48 includes a first portion 7300 and a second portion 7302 of a bus connected by a single transistor 7400, which can be an N-channel MOSFET. Each bus portion has a respective pull-up circuit 7304, 7308, each of which can include a resistor. When the first bus portion 7300 is driven low and the second bus portion 7302 is driven high, transistor 7400 conducts and pulls the second bus portion 7302 low. According to the present invention, the two portions 7300, 7302 of the bus are buss portions 36A and 36B, and the two pull-up circuits 7304, 7308, and the single MOSFET 7400, together constitute bi-directional signal driver 48 with signal drivers 42A and 42B. Other embodiments using wired-AND signal conductors can employ bi-directional signal drivers 48 such as those set forth in U.S. Pat. No. 6,122,704 to Hass et al. or U.S. Pat. No. 7,397,273 to Ng et al.

Figure 5:
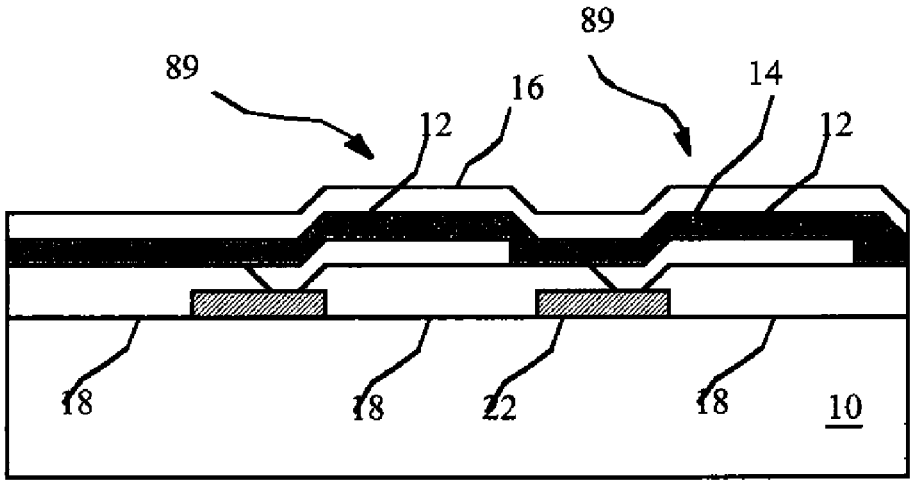
FIG. 5 is a cross section of an OLED pixel with a driving circuit according to an embodiment of the present invention.

In various embodiments of the present invention, a variety of pixel circuits 22 can be employed and a variety of technologies, for example chiplets or thin-film silicon circuits, used to construct the pixel circuits 22. Referring to FIG. 5, in one embodiment of the present invention, the pixel circuit 22 is an active circuit including thin-film transistors (TFTs) formed over the substrate 10. Each pixel 89 can have a separate pixel circuit 22. The TFTs drive a first electrode 12 that is patterned to form pixels. The TFTs are connected to the parallel signal conductor to receive pixel information from a controller. A layer of light-emitting material 14 is deposited over the first electrode 12 and a second electrode 16 formed over the layer of light-emitting material 14. The electrodes 12, 16, and layer of light-emitting material 14 form a light-emitting diode, or pixel, 89. The second electrode 16 can be common to multiple pixels, as shown. It is also known to provide active-matrix pixel control in a device employing a mono-crystalline silicon substrate.

Figure 6:
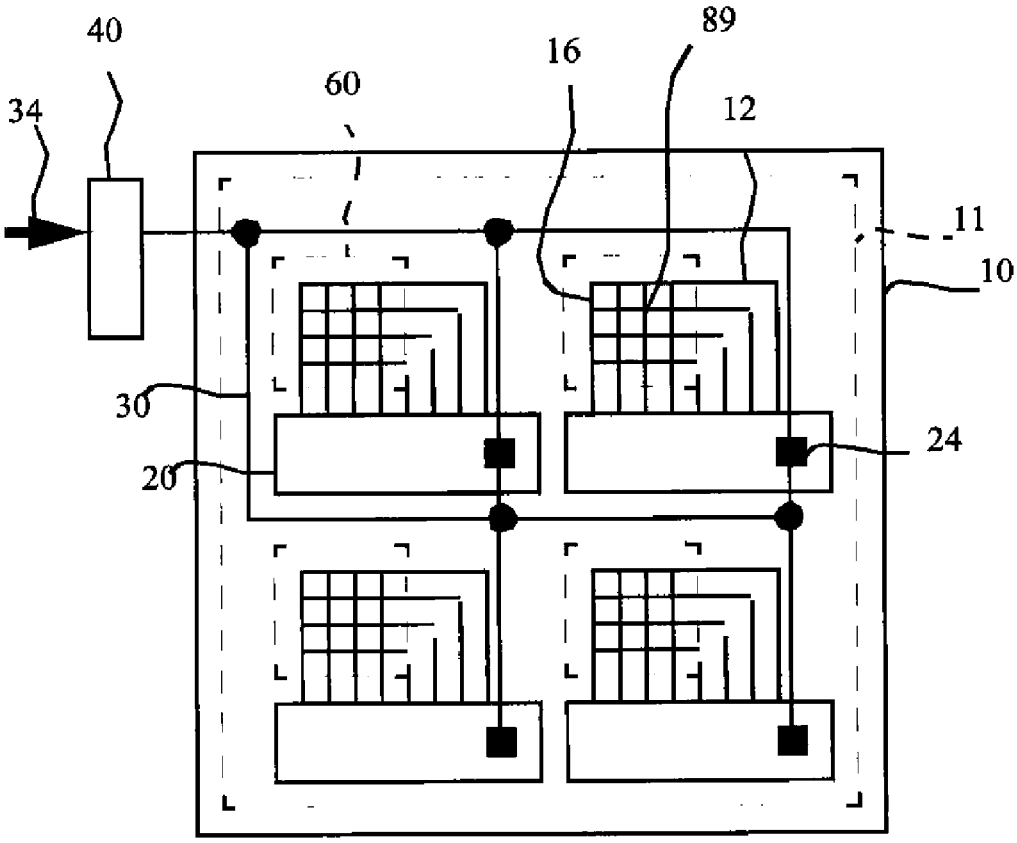
FIG. 6 is a schematic illustrating pixels and chiplets distributed over a display area having electrically separate pixel groups in an alternative embodiment of the present invention.

Referring to FIG. 6, in an alternative control design, the pixel circuits 22 are formed within a chiplet having a substrate separate from the display substrate 10, and a plurality of chiplets 20 are distributed over the substrate 10 in the display area. The chiplets 20 are electrically connected through connection pads 24 to the parallel signal conductor 30 to receive pixel information from a controller 40. The pixels are divided into mutually exclusive, electrically separate pixel groups 60. Each group 60 can form a two-dimensional sub-array of pixels, each group of pixels controlled by one or more chiplets 20. First electrodes 12 form horizontal rows and second electrodes 16 form vertical columns, with light-emitting material located between the electrodes 12, 16. Pixels are formed where the rows and columns of electrodes overlap. The pixel groups 60 are each driven independently in a passive-matrix arrangement by the chiplet 20.

The present invention can employ either a top-emitter or a bottom-emitter architecture. In a preferred embodiment, a top-emitter architecture is employed to improve the aperture ratio of the device and provide additional space over the substrate to route the parallel signal conductor and any other busses. The parallel signal conductors 30, and any other busses, can preferably be formed in a single layer.

Each chiplet 20 has a substrate that is independent and separate from the display device substrate 10. As used herein, distributed over the substrate 10 indicates that the chiplets 20 are not located solely around the periphery of the display array but are located within the array of pixels, that is, beneath, above, or between pixels (89 in FIG. 10) in the display area 11.

In operation, the controller 40 receives and processes an image signal 32 according to the needs of the display device to produce pixel information. The controller 40 then transmits the pixel information through the parallel signal conductor 30 to each chiplet 20 in the device. Additional control signals can be routed through the same or separate busses from the controller 40 to the chiplets. The pixel information includes luminance information for each optical element 15, which can be represented in volts, amps, or other measures correlated with pixel luminance. The pixel circuits 22 then provide appropriate control to the optical elements 15 in the pixels 89 to cause them to provide light according to the associated data value. The buss(es) can supply a variety of signals, including timing signals (e.g. clocks), data signals, select signals, power connections, or ground connections.

The controller 40 can be implemented as a chiplet and affixed to the substrate 10. The controller 40 can be located on the periphery of the substrate 10, or can be external to the substrate 10 and include a conventional integrated circuit.

According to various embodiments of the present invention, the chiplets 20 can be constructed in a variety of ways, for example with one or two rows of connection pads 24 along a long dimension of the chiplet 20. The parallel signal conductors 30 can be formed from various materials and use various methods for deposition on the device substrate. For example, the parallel signal conductors 30 can be metal, either evaporated or sputtered, for example aluminum or aluminum alloys. Alternatively, the parallel signal conductors 30 can be made of cured conductive inks or metal oxides.

Referring to FIG. 10, and also to FIGS. 6 and 11, the present invention is particularly useful for multi-pixel device embodiments employing a large device substrate, e.g. glass, plastic, or foil, with a plurality of chiplets 20 arranged in a regular arrangement over the device substrate 10. Each chiplet 20 can control a plurality of pixels 89 formed over the device substrate 10 according to the circuitry in the chiplet 20 and in response to control signals. Individual pixel groups or multiple pixel groups can be located on tiled elements, which can be assembled to form the entire display.

According to the present invention, chiplets 20 provide distributed pixel circuits 22 over a substrate 10. A chiplet 20 is a relatively small integrated circuit compared to the device substrate 10 and includes the pixel circuit 22 including wires, connection pads, passive components such as resistors or capacitors, or active components such as transistors or diodes, formed on an independent substrate. Chiplets 20 are made separately from the display substrate 10 and then applied to the display substrate 10. The chiplets 20 are preferably made using silicon or silicon on insulator (SOI) wafers using known processes for fabricating semiconductor devices. Each chiplet 20 is then separated prior to attachment to the device substrate 10. The crystalline base of each chiplet 20 can therefore be considered a substrate separate from the device substrate 10 and over which the one or more pixel circuit(s) 22 are disposed. The plurality of chiplets 20 therefore has a corresponding plurality of substrates separate from the device substrate 10 and each other. In particular, the independent substrates are separate from the substrate 10 on which the pixels 89 are formed and the areas of the independent, chiplet substrates, taken together, are smaller than the device substrate 10. Chiplets 20 can have a crystalline substrate to provide higher performance, and smaller active components, than are found in, for example, thin-film amorphous- or polycrystalline-silicon devices. According to one embodiment of the present invention, chiplets 20 formed on crystalline silicon substrates are arranged in a geometric array and adhered to a device substrate (e.g. 10) with adhesion or planarization materials. Connection pads 24 on the surface of the chiplets 20 are employed to connect each chiplet 20 to signal wires, power busses and row or column electrodes (16, 12) to drive pixels 89. Chiplets 20 can control at least four pixels 89. Chiplets 20 can have a thickness preferably of 100 um or less, and more preferably 20 um or less. This facilitates formation of the adhesive and planarization material over the chiplet 20 that can then be applied using conventional spin-coating techniques.

Since the chiplets 20 are formed in a semiconductor substrate, the circuitry of the chiplet can be formed using modern lithography tools. With such tools, feature sizes of 0.5 microns or less are readily available. For example, modern semiconductor fabrication lines can achieve line widths of 90 nm or 45 nm and can be employed in making the chiplets of the present invention. The chiplet 20, however, also requires connection pads 24 for making electrical connection to the wiring layer provided over the chiplets once assembled onto the display substrate 10. The connection pads 24 are sized based on the feature size of the lithography tools used on the display substrate 10 (for example 5 um) and the alignment of the chiplets 20 to the wiring layer (for example +/−5 um). Therefore, the connection pads 24 can be, for example, 15 um wide with 5 um spaces between the pads. This means that the pads will generally be significantly larger than the transistor circuitry formed in the chiplet 20. The connection pads 24 can generally be formed in a metallization layer on the chiplet 20 over the pixel circuit(s) 22. It is desirable to make the chiplet 20 with as small a surface area as possible to enable a low manufacturing cost.

Address values for chiplets can be selected arbitrarily, e.g. according to the 128-bit globally unique ID (GUID) standard known in the computer science art. Referring back to FIGS. 10 and 11, each pixel 89 can preferably have a unique address value. When multiple pixel circuits 22 are implemented within a single chiplet 20, each chiplet can preferably have a unique address value, and each packet of pixel information can include pixel information for each of the pixels 89 driven by the chiplet having an address corresponding to the address of the packet.

Address values can be assigned to chiplets by laser trimming or connection-pad strapping, as is known in the electronics art. Address values can also be assigned to chiplets by adjusting the mask for a silicon wafer of chiplets to provide a unique, wafer-coded address for each chiplet on the wafer. When using wafer-coded addresses, the same set of addresses can be used for each wafer.

According to one embodiment of the present invention, to make display 19 using chiplets 20, the following steps are performed. One or more wafers of chiplets, each having a unique address, and a substrate 11 are prepared as described above. A plurality of chiplets is selected from the wafer(s). A unique substrate location is then selected for each selected chiplet. The address and substrate location of each chiplet are recorded. The chiplets are adhered to the substrate at the corresponding substrate locations. The recorded addresses and substrate locations are then stored in a non-volatile memory, which can be a Flash memory, EEPROM, magnetic disk or other storage medium as known in the art. The non-volatile memory is then associated with the substrate. For example, when the non-volatile memory is an EEPROM stored in a memory chiplet, the memory chiplet can be adhered to the substrate and wired to the controller 40. When the non-volatile memory is a magnetic disk, it can be marked with a unique code corresponding to the substrate.

When the display 19 is in use, the controller 40 reads the stored addresses and substrate locations of the chiplets. The controller divides the image signal 32 into packets of pixel information corresponding to the substrate locations, one packet per substrate location, and therefore one packet per chiplet. The controller 40 assigns to each packet the chiplet address corresponding to the substrate location of the packet. This permits each chiplet to retrieve the corresponding pixel information, as described above.

A useful chiplet can also be formed using micro-electro-mechanical (MEMS) structures, for example as described in "A novel use of MEMs switches in driving AMOLED", by Yoon, Lee, Yang, and Jang, Digest of Technical Papers of the Society for Information Display, 2008, 3.4, p. 13.

The device substrate 10 can include glass, and wiring layers made of evaporated or sputtered metal or metal alloys, e.g. aluminum or silver, formed over a planarization layer 18 (e.g. resin) patterned with photolithographic techniques known in the art. In an embodiment of the present invention, parallel signal conductor 30 can include a multi-drop differential signal bus employing a signaling standard such as EIA-485 or EIA-899 (Multipoint LVDS), as known in the communications art. The substrate 10 can preferably be foil or another solid, electrically conductive material. Busses can include a differential signal pair laid out in a differential micro-strip configuration referenced to the substrate, as known in the electronics art. In displays using non-conductive substrates, the differential signal pair can preferentially be referenced to the second electrode.

The present invention can be practiced with LED devices, either organic or inorganic. In a preferred embodiment, the present invention is employed in a flat-panel OLED device composed of small-molecule or polymeric OLEDs as disclosed in, but not limited to U.S. Pat. No. 4,769,292 to Tang et al., and U.S. Pat. No. 5,061,569 to Van Slyke et al. Inorganic devices, for example, employing quantum dots formed in a polycrystalline semiconductor matrix (for example, as taught in U.S. Patent Application Publication No. 2007/0057263 by Kahen), and employing organic or inorganic charge-control layers, or hybrid organic/inorganic devices can be employed. Many combinations and variations of organic or inorganic light-emitting materials and structures can be used to fabricate such a device, including active-matrix displays having either a top- or a bottom-emitter architecture.

Figure 1D:
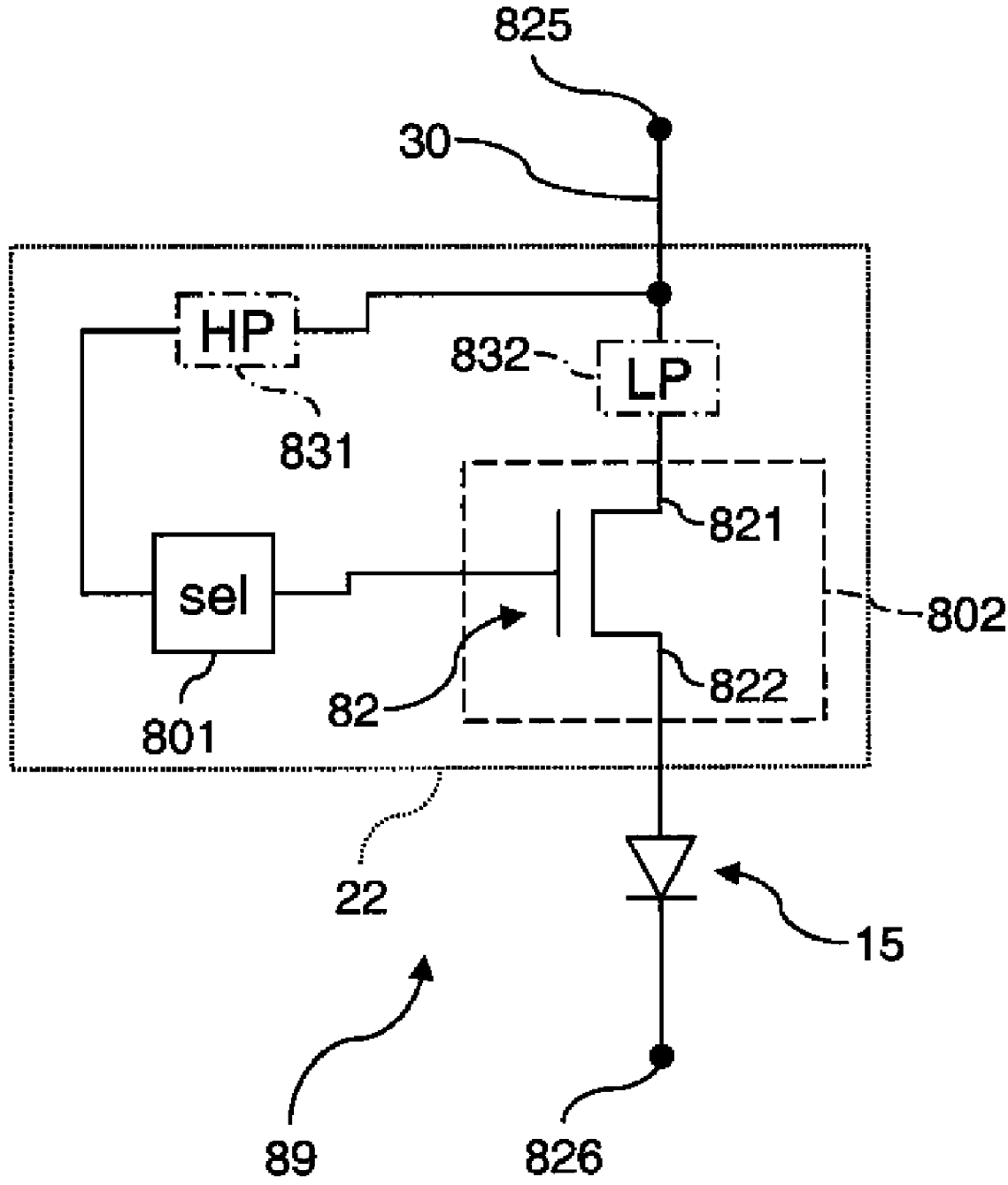
FIG. 1D is a schematic of a pixel in an embodiment of the present invention.
Figure 8:
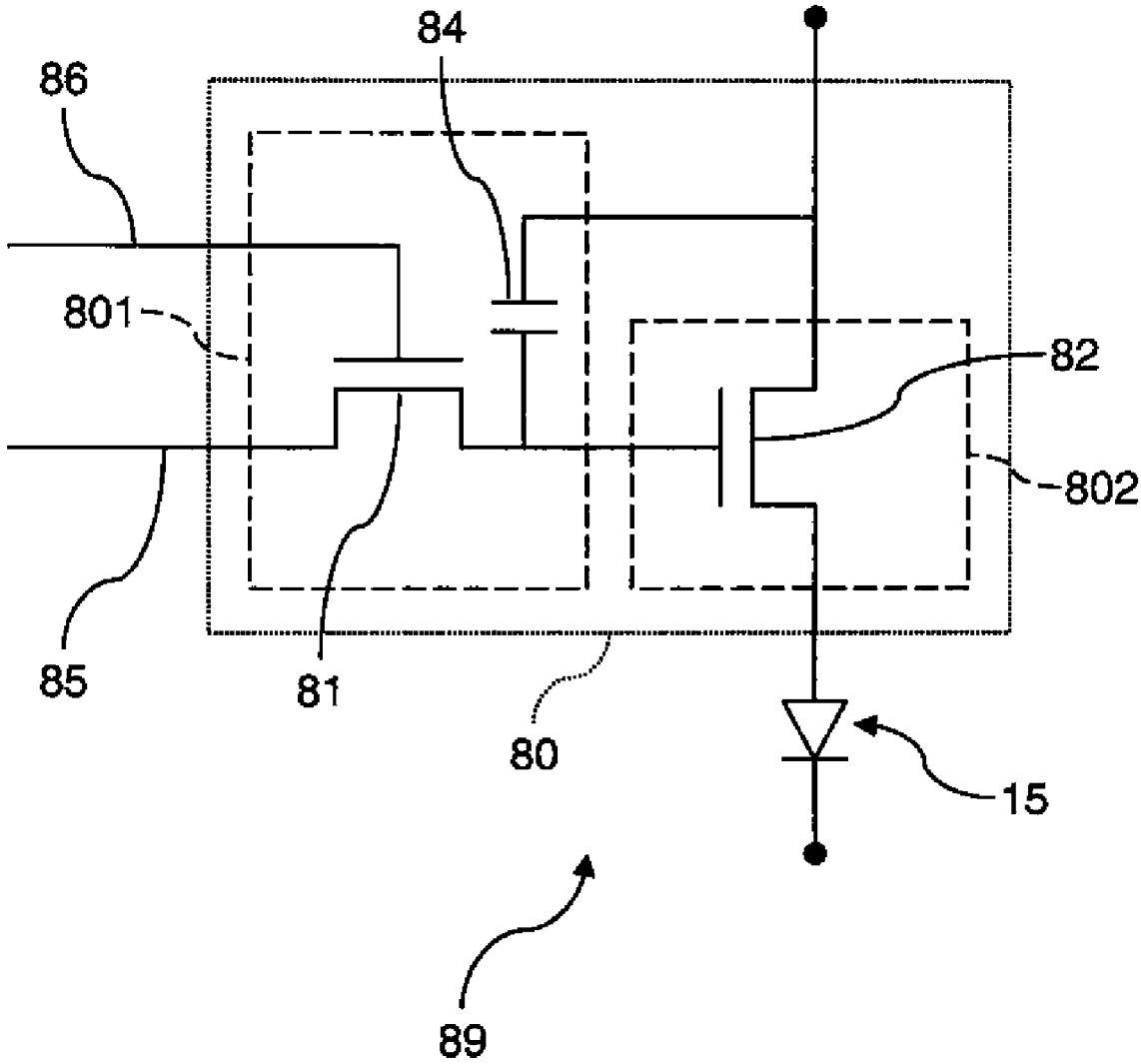
FIG. 8 (prior art)
FIG. 8 is a schematic of a pixel according to the prior art.
Figure 9:
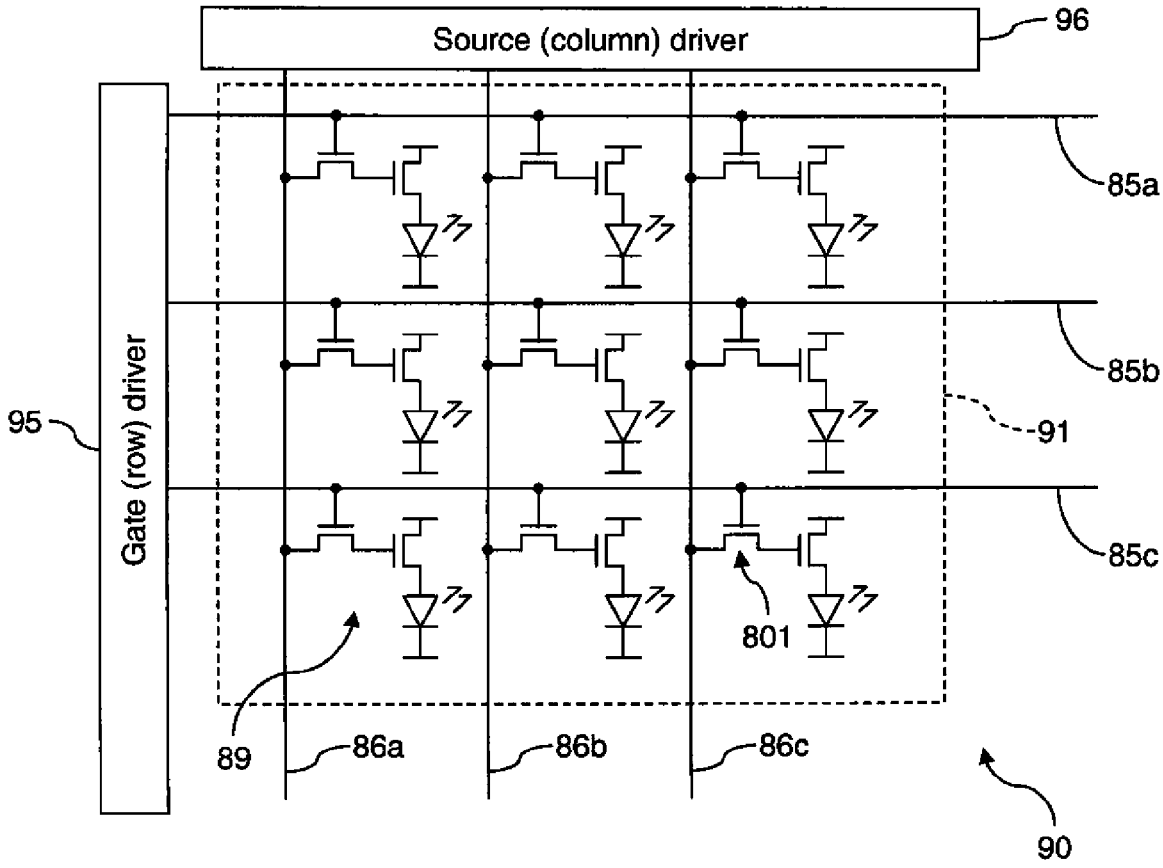
FIG. 9 (prior art)
FIG. 9 is a schematic of an active-matrix display according to the prior art.

According to the prior art, the power distribution buss uses conductors separate from the data signal lines and select signal lines shown in FIGS. 8 and 9 (e.g. FIG. 8 85, 86 respectively). In one embodiment of the present invention, power distribution and data transfer are carried out on a common conductor. Referring to FIG. 1D, pixel circuit 22 has driving circuit 802 comprising drive transistor 82. Drive transistor 802 has a first electrode 821 connected to first power supply 825 and a second electrode 822 connected to a first terminal of optical element 15. The first electrode 821 can be the source and the second electrode 822 the drain of drive transistor 82, or vice-versa. A second terminal of optical element 15 is connected to a second power supply 826.

Driving circuit 82, and specifically, drive transistor 802, is connected to a first power supply 825 using parallel signal conductor 30, which also serves as a power distribution buss. The parallel signal conductor 30 thus supplies electric current to the driving circuit, in addition to supplying pixel information to the selection circuit. When the parallel signal conductor 30 is connected to multiple driving circuits and selection circuits, it can supply electric current to all of the driving circuits and pixel information to all of the selection circuits.

The electric current and pixel information are multiplexed and demultiplexed using techniques for power line communication known in the art, such as the ITU-T G.hn standards (http://www.itu.int/ITU-T/jca/hn/index.phtml, retrieved 2009/03/27). These methods supply electric current at a selected base frequency (e.g. 0 Hz for DC) and pixel information modulated to a selected data carrier frequency higher than the base frequency. The parallel signal conductor 30 can thus supply electric current through low-pass filter 832 to the driving circuit 802, and supply pixel information through high-pass filter 831 to selection circuit 801. Low-pass filter 832 can be an RC low-pass filter as known in the art to extract the current, and high-pass filter 831 can be an RC high-pass filter or mixer as known in the art to extract the pixel information. One or both of the filters can be omitted, and other filter topologies employed, as will be obvious to those skilled in the art. For example, the low-pass filter 832 can be omitted since low-amplitude Vds noise on drive transistor 82 will have little effect on the current through optical element 15, as long as the modulation frequency of the pixel information is above a threshold for visibility of noise to humans as known in the image-science art.

The invention has been described in detail with particular reference to certain preferred embodiments thereof, but it should be understood that variations and modifications can be effected within the spirit and scope of the invention.

PARTS LIST

10 substrate
11 display area
12 electrode
14 light-emissive material
15 optical element
16 electrode
18 planarization layer
19 display
20, 20A, 20B chiplet
22 pixel circuit
24, 24A, 24B connection pad
30 parallel signal conductor, buss
32 image signal
34 interconnection
36, 36A, 36B buss portion
37 buss portion
38 buss portion
39 buss portion
40 controller
42, 42A, 42B signal driver
43 isolation driver
44 signal filter
46 storage circuit
48 bi-directional signal driver
60 pixel group
7300, 7302 bus portion
7304, 7308 pull-up circuit
7400 transistor
80 pixel circuit
801 selection circuit
802 driving circuit
81 select transistor
82 drive transistor
821 first electrode
822 second electrode
825 first power supply
826 second power supply
831 high-pass filter
832 low-pass filter
84 capacitor
85, 85*a*, 85*b*, 85*c* data signal line
86, 86*a*, 86*b*, 86*c* select signal line
89 pixel
90 display
91 matrix
95 gate driver
96 source driver

The invention claimed is:

1. A display device responsive to a controller, comprising:
(a) a substrate having a display area;
(b) a two-dimensional array of pixels formed on the substrate in the display area, each pixel comprising an optical element and a driving circuit for controlling the optical element in response to selected pixel information;
(c) a two-dimensional array of selection circuits located in the display area, each associated with one or more pixels, for selecting pixel information provided by the controller, wherein each selection circuit receives the provided pixel information, selects pixel information corresponding to its associated pixel(s) in response to the provided pixel information, and provides the selected pixel information to the corresponding driving circuit(s); and
(d) a parallel signal conductor electrically connecting the selection circuits in common for transmitting pixel information provided by the controller to each of the selection circuits.

2. The display device of claim 1, wherein each selection circuit is associated with only one driving circuit.

3. The display device of claim 1, wherein the pixels are arranged in rows and columns to form a two-dimensional array and wherein the parallel signal conductor forms a two-dimensional grid having intersections over the substrate in the display area.

4. The display device of claim 1, further including a data storage element associated with each pixel for storing the selected pixel information.

5. The display device of claim 1, wherein each pixel has a corresponding index and wherein the controller provides pixel information arranged in temporally sequential data values and each selection circuit counts the data values and selects the data value(s) corresponding to the index or indices of its associated pixel(s).

6. The display device of claim 1, wherein each pixel has a corresponding address and wherein the controller provides pixel information arranged in addressed packets and each selection circuit selects packet(s) having address(es) for its associated pixel(s).

7. The display device of claim 6, wherein each selection circuit includes circuitry defining the address(es) for its associated pixel(s).

8. The display device of claim 1, further comprising a plurality of chiplets, each containing at least one driving circuit and at least one selection circuit, wherein the chiplets are distributed over the substrate within the display area.

9. The display device of claim 8, wherein at least one chiplet contains only one selection circuit and a plurality of driving circuits.

10. The display device of claim 8, wherein the parallel signal conductor forms a two-dimensional grid having interconnections over the substrate in the display area, and at least a portion of the two-dimensional grid between the interconnections passes through a chiplet.

11. The display device of claim 8, wherein the parallel signal conductor forms a two-dimensional grid having intersections over the substrate in the display area and at least one intersection is located within a chiplet.

12. The display device of claim 11, wherein each chiplet further includes two or more connection pads, the parallel signal conductor is connected to at least two different connection pads on a first chiplet, and the two different connection pads are electrically connected within the first chiplet.

13. The display device of claim 1, wherein the controller is connected to the parallel signal conductor at more than one different location.

14. The display device of claim 13, wherein the controller includes separate signal drivers each connected at a different location to transmit pixel information in parallel on the parallel signal conductor.

15. The display device of claim 14, wherein the selection circuit further includes an isolation driver and a signal filter for filtering the pixel information transmitted in parallel.

16. The display device of claim 1, wherein the optical element comprises organic light-emitting materials located between first and second electrodes, and at least one of the first and second electrodes is connected to the driving circuit.

17. The display device of claim 16, wherein the second electrode is connected in common to the plurality of pixels.

18. The display device of claim 1, further including a bi-directional signal driver for receiving and transmitting the pixel information on the parallel signal conductor.

19. The display device of claim 1, wherein the at least one parallel signal conductor further supplies electric current to the plurality of driving circuits.

20. The display device of claim 1, wherein each selection circuit is associated with a plurality of driving circuits.

* * * * *